US008366843B2

(12) United States Patent
Mori

(10) Patent No.: US 8,366,843 B2
(45) Date of Patent: Feb. 5, 2013

(54) METHOD OF MANUFACTURING A MARTENSITIC STAINLESS STEEL PIPE

(75) Inventor: Nobuyuki Mori, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/727,467

(22) Filed: Mar. 27, 2007

(65) Prior Publication Data

US 2007/0246136 A1 Oct. 25, 2007

Related U.S. Application Data

(63) Continuation of application No. PCT/JP2005/017675, filed on Sep. 27, 2005.

(30) Foreign Application Priority Data

Sep. 28, 2004 (JP) ..... 2004-281711

(51) Int. Cl.
*C21D 9/08* (2006.01)

(52) U.S. Cl. ..... 148/592; 148/593; 148/590

(58) Field of Classification Search ..... 148/592, 148/392

See application file for complete search history.

(56) References Cited

U.S. PATENT DOCUMENTS 6,846,371 B2 * 1/2005 Miyata et al. ..... 148/593

FOREIGN PATENT DOCUMENTS

| | | | |
|---|---|---|---|
| EP | 0 937 782 | A2 | 8/1999 |
| EP | 1 288 316 | A1 | 3/2003 |
| GB | 2 230 024 | A | 10/1990 |
| JP | 63-238217 | | 10/1988 |
| JP | 63-241117 | | 10/1988 |
| JP | 63-293111 | | 11/1988 |
| JP | 1-123024 | | 5/1989 |
| JP | 1-123027 | | 5/1989 |
| JP | 01-123029 | | 5/1989 |
| JP | 02-277720 | | 11/1990 |
| JP | 4-110420 | | 4/1992 |
| JP | 05-171361 | | 7/1993 |
| JP | 06-072261 | B2 * | 9/1994 |
| JP | 11-310822 | | 11/1999 |
| JP | 2003-105441 | | 4/2003 |

OTHER PUBLICATIONS

Dennis Smyth, "Steel Tubular Products," ASM Handbook vol. 1 (1990), pp. 327-336.*

* cited by examiner

*Primary Examiner* — Roy King
*Assistant Examiner* — Christopher Kessler
(74) *Attorney, Agent, or Firm* — Clark & Brody

(57) ABSTRACT

A method of manufacturing a 13Cr steel pipe which satisfies a hardness (HRC) of at most 22 with 13Cr grade L80 of American Petroleum Institute (API) standards, which is an indicator of a high strength, high yield ratio, and good corrosion resistance, is provided. A steel billet having a chemical composition comprising, in mass percent, C: 0.15-0.21%, Si: 0.16-1.0%, Mn: 0.35-1.0%, Cr: 10.5-14.0%, P: at most 0.020%, S: at most 0.0050%, Al: 0.025-0.050%, and a remainder of Fe and impurities is subjected to hot working with a finishing temperature of 800-960° C. to form a mother pipe, which is immediately quenched at a cooling rate of at least air cooling and then tempered by heating.

2 Claims, 1 Drawing Sheet

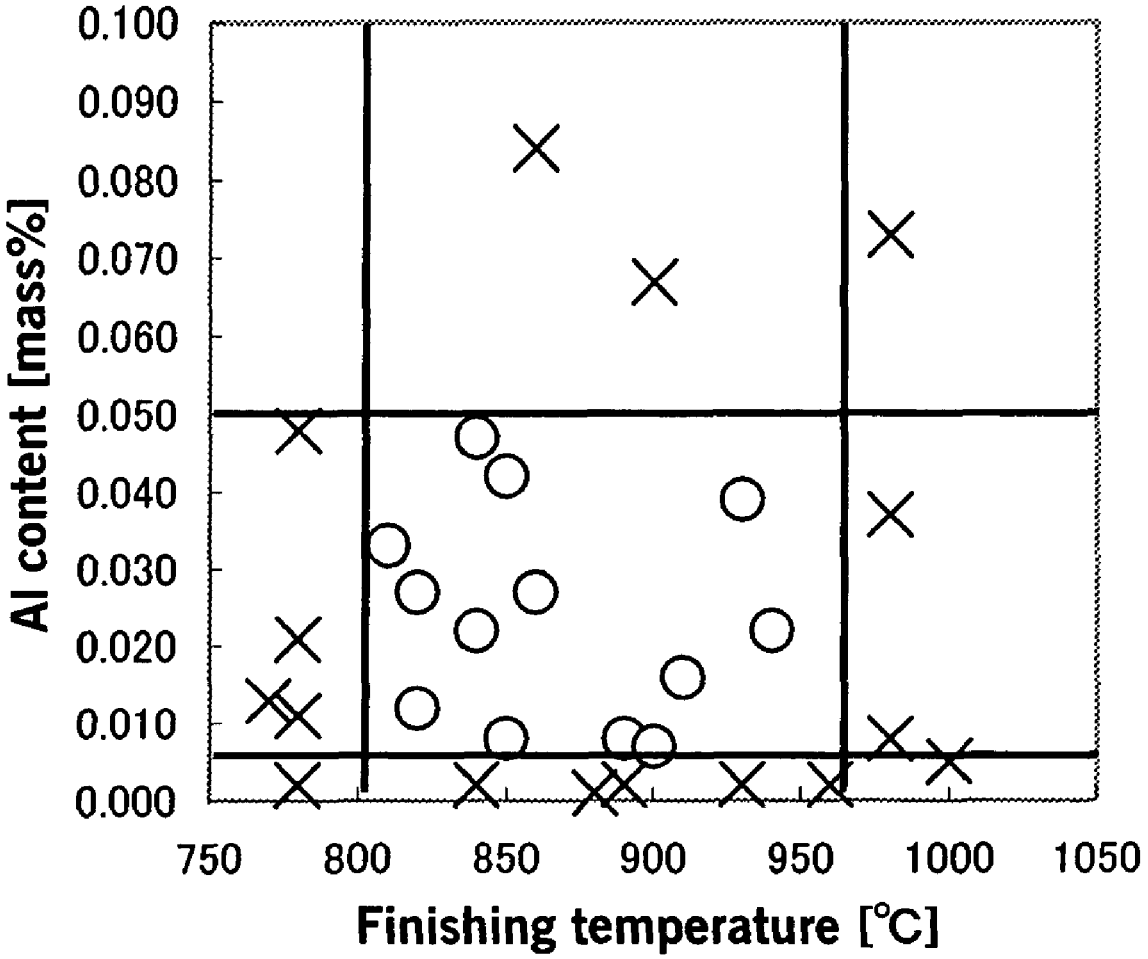
0.100
0.090
0.080
0.070
0.060
0.050
0.040
0.030
0.020
0.010
0.000
Al content [mass%]
750
800
850
900
950
1000
1050
Finishing temperature [°C]

METHOD OF MANUFACTURING A MARTENSITIC STAINLESS STEEL PIPE

This application is a continuation of International Patent Application No. PCT/JP2005/017675, filed Sep. 27, 2005. This PCT application was not in English as published under PCT Article 21(2).

TECHNICAL FIELD

This invention relates to a method of manufacturing a martensitic stainless steel pipe and particularly a method of manufacturing a seamless martensitic stainless steel pipe having a high yield ratio.

BACKGROUND ART

As has been well known in the art, a 13Cr steel containing approximately 0.2% of C and approximately 13% of Cr (this steel is referred to below simply as a "13Cr steel") has excellent resistance to corrosion by infiltrating carbon dioxide gas, and it is less expensive compared to a super 13Cr steel having a decreased C content or a duplex stainless steel, so it is much used for oil country tubular goods (oil well tubing, casing, and drill pipes). A seamless steel pipe made of this 13Cr steel is manufactured by hot working a billet to form a mother pipe followed by quenching and annealing.

Patent Document 1 discloses a method for increasing toughness by the direct quenching technique (DQT) in which quenching is carried out immediately after a 13Cr steel has been hot worked to form a mother pipe. This method does not involve reheating of a mother pipe which has been cooled prior to performing quenching, and thus it is advantageous from the standpoints of productivity and costs.

Patent Document 1: JP H02-277720 A1

DISCLOSURE OF INVENTION

Problem which the Invention is to Solve

However, the method disclosed in Patent Document 1 focuses only on toughness which is a mechanical property, and there is no mention therein of corrosion resistance. With this method in which only toughness is controlled, it is difficult to manufacture a 13Cr steel pipe which satisfies a hardness (HRC=Rockwell Hardness scale C) of at most 22 with 13Cr grade L80 of the American Petroleum Institute (API) standards, which is an indicator of a high strength, a high yield ratio, and good corrosion resistance which have been demanded in recent years.

Accordingly, the object of the present invention is to provide an inexpensive method of manufacturing a corrosion resistant seamless martensitic steel pipe having a high strength and a high yield ratio with good productivity. Specifically, it provides a method of manufacturing a seamless martensitic stainless steel pipe which can satisfy, for example, a yield point (YP) of 552-656 MPa, a tensile strength (TS) of at least 657 MPa, a yield ratio of at least 75%, a toughness such that the fracture appearance transition temperature in a Charpy impact test is 0° C. or lower (shape of test piece: 10×10 mm with a 2 mm V-shaped notch in the L direction), and a HRC hardness of at most 22.

Means for Solving the Problem

The present inventors conjectured that it should be possible to manufacture a steel pipe of 13Cr steel having a high strength, a high yield ratio, and good corrosion resistance at a low cost and with high productivity by the direct quenching technique, and they investigated the direct quenching technique under various conditions to solve the above-described problem.

As a result, it was found that by adjusting the composition of a steel and particularly restricting the Al content to a certain range and at the same time limiting the finishing temperature of hot working to a certain range, the above-described high strength and high yield ratio as well as good corrosion resistance are simultaneously satisfied. The mechanism for simultaneously satisfying a high strength and high yield ratio and good corrosion resistance is not clear, but it was found that it was necessary to limit the Al content and the finishing temperature in optimal ranges, as a result of which the present invention was completed.

The present invention is as follows.

(1) A method of manufacturing a seamless martensitic stainless steel pipe characterized by forming a mother pipe from a steel billet having a chemical composition comprising, in mass percent, C: 0.15-0.21%, Si: 0.16-1.0%, Mn: 0.35-1.0%, Cr: 10.5-14.0%, P: at most 0.020%, S: at most 0.0050%, Al: 0.025-0.050%, and a remainder of Fe and impurities by means of hot working with a finishing temperature of 800-960° C., immediately subjecting the resulting mother pipe to quenching at a cooling rate greater than or equal to that of air cooling, and then heating the pipe for tempering.

(2) A method of manufacturing a seamless martensitic stainless steel pipe as set forth above in (1), wherein the chemical composition further contains at least one of Mo: at most 2.0%, V: at most 0.50%, and Nb: at most 0.50%.

(3) A method of manufacturing a seamless martensitic stainless steel pipe as set forth above in (1) or (2), wherein the Al content in the chemical composition is Al: 0.005-0.050% and wherein the finishing temperature is 850-960° C.

BRIEF DESCRIPTION OF THE DRAWINGS

FIG. 1 is a graph showing the results of examples.

BEST MODE FOR CARRYING OUT THE INVENTION

Next, the reasons why the chemical composition and the heat treatment conditions of a steel are determined as described above in the present invention will be explained. In this specification, unless otherwise specified, percent with respect to the chemical composition of steel means mass percent.

The composition of the steel according to the present invention is as follows.

C: 0.15-0.21%

In the manufacturing method according to the present invention, it is necessary to limit the range of C content in order to obtain a suitable strength, yield ratio, and hardness. If the C content is less than 0.15%, a desired strength is not obtained, while if it exceeds 0.21%, the strength becomes too high and it becomes difficult to adjust the yield ratio and hardness. Accordingly, the C content is 0.15-0.21%.

Si: 0.16-1.0%

Si is added as a deoxidizing agent of steel. In order to obtain this effect, at least 0.16% of Si is added. Its upper limit is made 1.0% in order to prevent a degradation in toughness. Preferably the Si content is 0.16-0.50%.

Mn: 0.35-1.0%

Like Si, Mn is added as a deoxidizing agent. In order to obtain this effect, at least 0.35% of Mn is added. However, since addition of Mn in a too large an amount causes the toughness of steel to deteriorate, its upper limit is made at most 1.0%.

Cr: 10.5-14.0%

In a steel according to the present invention, Cr is the key element for obtaining the necessary corrosion resistance. Addition of at least 10.5% Cr produces an improvement in corrosion resistance with respect to pitting and crevice corrosion and a significant improvement in corrosion resistance in a $CO_2$ environment. However, since Cr is a ferrite-forming element, a Cr content exceeding 14% makes it easy that δ ferrite forms during working at high temperatures, thereby adversely affecting the hot workability of steel and decreasing the strength thereof after heat treatment, so its content is limited to at most 14.0%.

P: at most 0.020%

Since the presence of P in a large amount causes the toughness of steel to deteriorate, its content is at most 0.020%.

S: at most 0.0050%

The upper limit of S is 0.0050% since the presence of S in a large amount causes the toughness of steel to deteriorate and worsens the quality of the inner surface of the steel pipe due to occurrence of segregation.

Al: 0.025-0.050%

It is important for the present invention to limit the Al content. If the Al content is less than 0.025%, a desired strength and yield ratio are not obtained. On the other hand, if the Al content exceeds 0.050%, the amount of $Al_2O_3$ inclusions in the steel increases, and the toughness and corrosion resistance thereof deteriorate. Therefore, the Al content is 0.025-0.050%. However, when the finishing temperature of hot working is 850° C. or higher, it is possible to lower the lower limit of Al content to 0.005%. This is because if the finishing temperature of final rolling is a higher temperature, it is difficult for the effects of rolling to remain in the material after rolling, resulting in an increased yield ratio of the material. In this case as well, a lower limit of Al content is preferably 0.025%. In either mode, the preferred upper limit is 0.050%.

In addition to the above, a steel according to the present invention comprises Fe and impurities. There is no particular limit on the content of N as an impurity, but an N content exceeding 0.100% causes the toughness of steel to decrease, so it is preferably made at most 0.100%. The steel may also contain at most 0.15% of Ni and at most 0.08% of Ti as impurities.

A portion of Fe may be replaced by at least one of the following elements.

Mo: at most 2.0%

Mo need not be added. If it is added, it has an effect of increasing strength and corrosion resistance. For this purpose, preferably at least 0.02% of Mo is added. However, if the Mo content exceeds 2.0%, it becomes difficult for a martensitic transformation to take place, so its upper limit is 2.0%.

V: at most 0.50%

V need not be added. If it is added, it provides the effects of increasing strength and particularly of increasing YR (yield ratio=yield point/tensile strength). For this purpose, preferably at least 0.04% of V is added. However, a V content exceeding 0.50% decreases the toughness of the steel, so the upper limit of V is 0.50%. V is an expensive alloying element, and in view of economical efficiency, its upper limit is more preferably 0.30%.

Nb: at most 0.50%

Nb need not be added. If it is added, it has the effect of increasing strength. For this purpose, it is preferably added in an amount of at least 0.002%. However, if the Nb content exceeds 0.50%, the steel has a decreased toughness, so its upper limit is 0.50%.

In the present invention, the chemical composition of the steel is limited as described above, and at the same time, the finishing temperature in final rolling during hot working is made to fall into a predetermined range. Hot working at this time is hot rolling in a usual pipe forming method, so below, an explanation will be given of an example in which hot working is hot rolling.

If the finishing temperature in final rolling is less than 800° C., the effects of hot working remain in the steel, thereby adversely affecting the yield ratio and toughness of steel. On the other hand, if the finishing temperature in final rolling exceeds 960° C., crystal grains are coarsened, and the toughness and corrosion resistance are worsened in this case as well. Accordingly, the finishing temperature in final rolling is at least 800° C. and at most 960° C.

When the finishing temperature in final rolling during hot working is limited to at least 850° C. and at most 960° C., even if the Al content is lower than the above-described range, it is possible to provide the steel with the desired strength, toughness, and corrosion resistance. Specifically, strength, toughness, and corrosion resistance can be satisfied when the Al content is in the range of 0.005-0.050%.

Since the present invention is a method of manufacturing a steel pipe, hot rolling in the present invention can be performed as follows, for example. First, after molten steel is adjusted to have a predetermined chemical composition, a billet is manufactured therefrom by a method such as conventional continuous casting. After the billet is heated to at least 1200° C., for example, it is pierced with a piercer or the like and then subjected to hot rolling in a mandrel mill, a reducer, or the like to produce a steel pipe having a predetermined outer diameter and wall thickness, i.e., a mother pipe. Hot rolling can be carried out in a different rolling mill such as a plug mill.

In the present invention, the manufacturing conditions of hot rolling or the like are adjusted so that the temperature of a mother pipe at the completion of hot rolling falls into the above-described temperature range. After the completion of hot rolling, the mother pipe is cooled. Usually it is sufficient to cool to room temperature by air cooling. With a steel pipe having a chemical composition defined by the present invention, quench-hardening takes place and a martensitic structure is obtained even with air cooling.

Tempering is then carried out so as to achieve desired mechanical properties. For example, tempering may be carried out by heating the pipe to 700-750° C. followed by cooling. There is no particular restriction on the cooling rate in this case. Cooling is normally carried out at least at the cooling rate of air cooling, such as at least 2° C. per second.

A product which is obtained in this manner then undergoes inspection, threading process, and the like to obtain a finished product. In the case of the present invention, there are no restrictions on the dimensions of the mother pipe. An example is an outer diameter of 88.1 mm and a wall thickness of 6.95 mm.

The effects of the present invention will next be described more specifically by the following example.

Example

A molten steel having the chemical composition shown in Table 1 was prepared, and it was subjected to continuous casting and then forging to prepare a billet with dimensions of an outer diameter of 191 mm and a length of 2400 mm. This billet was heated to at least 1200° C. and it was pierced in a plug mill. The mother pipe which was obtained in this manner was heated to a predetermined temperature in a reheating furnace and then passed through a mandrel mill or reducer for final rolling in a hot state to manufacture a seamless steel pipe with predetermined dimensions (an outer diameter of 88.90 mm and a wall thickness of 6.45 mm).

The heating conditions in the reheating furnace and the rolling conditions were adjusted in order to vary the temperature of the pipe at the time of completion of final rolling, namely, the finishing temperature of hot rolling. The mother pipe was then air cooled to room temperature at a rate of 20° C. per second, and then it was subjected to tempering at 700-750° C. Table 1 shows the finishing temperature and the tempering temperature for each steel sample.

Test pieces in accordance with API 5CT were cut from each pipe which was manufactured in this manner, and the resulting arcuate test pieces were used for measurement of tensile strength, yield point, HRC hardness, and transition temperature by a Charpy impact test (shape: 10×5 mm with a 2-mm V-notch).

Evaluation was carried out on the basis of desired properties to be satisfied which include a tensile strength satisfying API grade L80 (YP: 552-656 MPa, TS: at least 657 MPa), an HRC hardness of at most 22, and a fracture appearance transition temperature (vTrs) in a Charpy impact test of 0° C. or lower.

The results are shown in Table 1. Each of Examples 1-13 which fell into the range of the present invention not only satisfied the above-described mechanical strength but also exhibited adequate corrosion resistance as evaluated by hardness.

FIG. 1 compiles the results of Table 1 in the form of a graph. In the figure, CIRCLE (O) and X have the following meanings.

CIRCLE (O): HRC≦22.0 and vTrs≦0° C. were both satisfied X: at least one of HRC≦22.0 and vTrs≦0° C. could not be satisfied It can be seen that when the Al content and the finishing temperature were in the ranges defined by the present invention, HRC≦22.0 and vTrs≦0° C. were both satisfied.

TABLE 1

| | Chemical Composition (mass %) | | | | | | | | | | |
|---|---|---|---|---|---|---|---|---|---|---|---|
| No. | C | Si | Mn | P | S | Cr | Mo | V | Nb | sol. Al | N |
| 1 | 0.19 | 0.22 | 0.67 | 0.015 | 0.0011 | 12.12 | — | — | — | 0.027 | 0.0374 |
| 2 | 0.20 | 0.26 | 0.39 | 0.019 | 0.0014 | 12.87 | — | — | — | 0.042 | 0.0456 |
| 3 | 0.19 | 0.25 | 0.91 | 0.015 | 0.0012 | 12.22 | — | — | — | 0.008 | 0.0452 |
| 4 | 0.18 | 0.18 | 0.97 | 0.013 | 0.0009 | 11.39 | — | 0.04 | 0.002 | 0.039 | 0.0467 |
| 5 | 0.17 | 0.30 | 0.89 | 0.013 | 0.0009 | 12.61 | — | 0.07 | 0.002 | 0.027 | 0.0394 |
| 6 | 0.18 | 0.19 | 0.68 | 0.014 | 0.0006 | 12.46 | — | — | 0.002 | 0.033 | 0.0356 |
| 7 | 0.19 | 0.34 | 0.7 | 0.018 | 0.0012 | 12.57 | — | 0.06 | — | 0.047 | 0.0402 |
| 8 | 0.16 | 0.25 | 0.75 | 0.020 | 0.0036 | 13.15 | 0.02 | 0.06 | 0.003 | 0.016 | 0.0254 |
| 9 | 0.20 | 0.41 | 0.38 | 0.014 | 0.0006 | 11.95 | — | — | 0.002 | 0.022 | 0.0326 |
| 10 | 0.19 | 0.46 | 0.55 | 0.015 | 0.0030 | 13.87 | 0.02 | 0.05 | 0.002 | 0.008 | 0.0200 |
| 11 | 0.17 | 0.25 | 0.91 | 0.013 | 0.0044 | 12.59 | — | — | 0.004 | 0.007 | 0.0490 |
| 12 | 0.17 | 0.36 | 0.86 | 0.016 | 0.0021 | 12.89 | — | 0.05 | 0.002 | 0.022 | 0.0388 |
| 13 | 0.18 | 0.18 | 0.44 | 0.018 | 0.0023 | 12.80 | — | — | 0.006 | 0.012 | 0.0451 |
| 14 | 0.19 | 0.36 | 0.33 | 0.020 | 0.0018 | 12.50 | — | 0.09 | — | 0.013 | 0.0246 |
| 15 | 0.19 | 0.22 | 0.87 | 0.010 | 0.0017 | 11.80 | 0.02 | — | 0.008 | 0.005 | 0.0549 |
| 16 | 0.20 | 0.26 | 0.91 | 0.013 | 0.0013 | 12.65 | 0.02 | 0.04 | 0.002 | 0.048 | 0.0470 |
| 17 | 0.19 | 0.19 | 0.88 | 0.014 | 0.0011 | 12.54 | — | — | — | 0.021 | 0.0440 |
| 18 | 0.18 | 0.78 | 0.90 | 0.012 | 0.0009 | 12.58 | 0.02 | 0.04 | 0.002 | 0.037 | 0.0446 |
| 19 | 0.19 | 0.34 | 0.75 | 0.014 | 0.0016 | 12.62 | — | 0.04 | 0.002 | 0.011 | 0.0478 |
| 20 | 0.18 | 0.48 | 0.48 | 0.014 | 0.0008 | 12.55 | — | — | — | 0.008 | 0.0275 |
| 21 | 0.19 | 0.56 | 0.68 | 0.015 | 0.0054* | 12.60 | — | 0.11 | — | 0.002* | 0.0272 |
| 22 | 0.22* | 0.33 | 1.23* | 0.016 | 0.0015 | 12.80 | 0.02 | 0.08 | 0.003 | 0.001* | 0.0250 |
| 23 | 0.19 | 1.13* | 0.70 | 0.015 | 0.0043 | 12.50 | — | 0.12 | 0.002 | 0.002* | 0.0277 |
| 24 | 0.19 | 0.37 | 0.67 | 0.013 | 0.0058* | 12.60 | 0.03 | 0.11 | 0.004 | 0.002* | 0.0248 |
| 25 | 0.19 | 0.33 | 0.71 | 0.015 | 0.0024 | 12.50 | — | 0.10 | 0.002 | 0.073* | 0.0221 |
| 26 | 0.19 | 0.87 | 0.59 | 0.025* | 0.0031 | 12.60 | — | 0.07 | — | 0.084* | 0.0236 |
| 27 | 0.20 | 1.20* | 0.73 | 0.018 | 0.0008 | 13.00 | — | 0.13 | — | 0.002* | 0.0229 |
| 28 | 0.20 | 0.34 | 0.72 | 0.016 | 0.0079* | 12.70 | 0.03 | 0.12 | 0.003 | 0.002* | 0.0263 |
| 29 | 0.18 | 0.26 | 0.49 | 0.016 | 0.0021 | 12.73 | 0.02 | 0.08 | 0.002 | 0.106* | 0.0514 |
| 30 | 0.19 | 0.23 | 0.88 | 0.014 | 0.0084* | 12.50 | 0.02 | 0.05 | 0.002 | 0.067* | 0.0451 |
| 31 | 0.20 | 1.03* | 1.04* | 0.020 | 0.0005 | 12.50 | — | — | 0.025 | 0.005 | 0.0253 |
| 32 | 0.14* | 0.34 | 0.08* | 0.010 | 0.0034 | 13.10 | — | 0.06 | — | 0.009 | 0.0325 |

| No. | Finishing temp. [° C.] | Tempering temp. [° C.] | YP [MPa] | TS [MPa] | YR [%] | Mean hardness [HRC] | Charpy vTrs [° C.] | |
|---|---|---|---|---|---|---|---|---|
| 1 | 820 | 705 | 590 | 768 | 76.8 | 20.6 | −18 | Inventive |
| 2 | 850 | 730 | 581 | 761 | 76.3 | 21.6 | −15 | |
| 3 | 850 | 705 | 577 | 763 | 75.6 | 22.0 | −10 | |
| 4 | 930 | 710 | 574 | 759 | 75.6 | 21.3 | −6 | |
| 5 | 860 | 745 | 573 | 760 | 75.4 | 21.8 | −12 | |
| 6 | 810 | 740 | 570 | 758 | 75.2 | 21.3 | −14 | |
| 7 | 840 | 750 | 573 | 762 | 75.2 | 21.8 | −8 | |
| 8 | 910 | 715 | 562 | 742 | 75.7 | 20.9 | −16 | |
| 9 | 940 | 710 | 568 | 752 | 75.5 | 21.4 | −22 | |
| 10 | 890 | 715 | 567 | 748 | 75.8 | 20.9 | −13 | |
| 11 | 900 | 715 | 562 | 741 | 75.8 | 21.0 | −5 | |

TABLE 1-continued

| | | | | | | | | |
|---|---|---|---|---|---|---|---|---|
| 12 | 870 | 740 | 572 | 762 | 75.1 | 21.6 | −3 | |
| 13 | 850 | 740 | 567 | 755 | 75.1 | 21.1 | −5 | |
| 14 | 770* | 750 | 568 | 766 | 74.2 | 22.1 | 23 | Comparative |
| 15 | 1000* | 700 | 573 | 755 | 75.9 | 21.8 | 18 | |
| 16 | 780* | 750 | 569 | 771 | 73.8 | 22.6 | 14 | |
| 17 | 780* | 700 | 571 | 768 | 74.3 | 22.3 | 15 | |
| 18 | 980* | 710 | 571 | 754 | 75.7 | 21.4 | 21 | |
| 19 | 800* | 750 | 569 | 770 | 73.9 | 22.5 | 19 | |
| 20 | 980* | 700 | 562 | 769 | 73.1 | 22.5 | 7 | |
| 21 | 840 | 730 | 561 | 764 | 73.4 | 22.2 | 26 | |
| 22 | 880 | 720 | 557 | 760 | 73.3 | 22.0 | 35 | |
| 23 | 930 | 720 | 554 | 759 | 73.0 | 22.1 | 24 | |
| 24 | 960* | 720 | 564 | 758 | 74.4 | 22.2 | 29 | |
| 25 | 980* | 720 | 559 | 737 | 75.8 | 20.4 | 16 | |
| 26 | 860 | 730 | 571 | 749 | 76.2 | 21.3 | 29 | |
| 27 | 780* | 750 | 555 | 759 | 73.1 | 22.2 | 31 | |
| 28 | 890 | 730 | 561 | 764 | 73.4 | 22.3 | 36 | |
| 29 | 970* | 700 | 562 | 739 | 76.0 | 20.5 | 18 | |
| 30 | 900 | 710 | 570 | 751 | 75.9 | 21.1 | 34 | |
| 31 | 930 | 700 | 568 | 753 | 75.4 | 21.3 | 24 | |
| 32 | 880 | 720 | 569 | 753 | 75.6 | 21.2 | 8 | |

*outside the range of the present invention;
TS: tensile strength;
YP: yield point;
YR: yield ratio

Industrial Applicability

Thus, according to the present invention, a martensitic stainless steel pipe of a 13Cr steel can be manufactured with good productivity and low costs by the direct quenching technique, whereby current demands for a decrease in production costs can be satisfied.

The invention claimed is:

1. A method of manufacturing a seamless martensitic stainless steel pipe comprising the steps of:

a) piercing a billet to form a pierced billet, b) subjecting the pierced billet to a hot working step to form a mother pipe and then subjecting the hot worked mother pipe to an immediate quenching step, wherein the method does not involve cooling and reheating of the hot worked mother pipe prior to performing quenching, and wherein the hot working step is either:

1) hot working the pierced billet using a mandrel mill reducer to form the mother pipe, wherein the hot working includes a final rolling occurring between the piercing step and the immediate quenching step, the final rolling having a finishing temperature of 850-960° C., the pierced billet having a chemical composition comprising, in mass percent, C: 0.15-0.21%, Si: 0.16-1.0%, Mn: 0.35-1.0%, Cr: 10.5-14.0%, P: at most 0.020%, S: at most 0.005%, Al: 0.005-0.050%, and a remainder of Fe and impurities, or 2) hot working the pierced billet using a mandrel mill reducer to form the mother pipe, wherein the hot working includes a final rolling occurring between the piercing step and the immediate quenching step, the final rolling having a finishing temperature of 800-850° C., the pierced billet having a chemical composition comprising, in mass percent, C: 0.15-0.21%, Si: 0.16-1.0%, Mn: 0.35-1.0%, Cr: 10.5-14.0%, P: at most 0.020%, S: at most 0.005%, Al: 0.025-0.050%, and a remainder of Fe and impurities, and further wherein the immediate quenching step is at a cooling rate greater than or equal to that of air cooling to produce a quenched pipe, and c) tempering the immediately quenched pipe of step (b) to provide a seamless martensitic stainless steel pipe having HRC of 22 or less, vTrs of 0° C. or lower and a tensile strength of at least 657 MPa.

2. A method of manufacturing a seamless martensitic stainless steel pipe as set forth in claim 1, wherein the chemical composition further contains at least one of Mo: at most 2.0%, V: at most 0.50%, and Nb: at most 0.50%.

* * * * *